US005505592A

United States Patent [19]

Kumagai et al.

[11] Patent Number: 5,505,592

[45] Date of Patent: Apr. 9, 1996

[54] VARIABLE CAPACITY VANE COMPRESSOR

[75] Inventors: Shuzo Kumagai; Syoiti Fukuda; Syouji Shimada; Hidetoshi Arahata, all of Kounan, Japan

[73] Assignee: Zexel Corporation, Tokyo, Japan

[21] Appl. No.: 396,699

[22] Filed: Mar. 1, 1995

[30] Foreign Application Priority Data

Mar. 11, 1994 [JP] Japan ..... 6-067665
Jul. 21, 1994 [JP] Japan ..... 6-190914

[51] Int. Cl.[6] ..... F04C 29/10
[52] U.S. Cl. ..... 417/213; 418/134
[58] Field of Search ..... 418/134; 417/220, 417/213

[56] References Cited

U.S. PATENT DOCUMENTS 4,046,493 9/1977 Ålund ..... 417/220

FOREIGN PATENT DOCUMENTS 63-259190 10/1988 Japan .

*Primary Examiner*—Richard E. Gluck
*Attorney, Agent, or Firm*—Frishauf, Holtz, Goodman, Langer & Chick

[57] ABSTRACT

An annular piston abuts on an end face of a rotation plate on a side remote from a hollow cylinder via a thrust bearing, and delivery pressure is introduced to an end face of an annular piston on a side remote from the rotation plate via a high pressure-introducing passage. The delivery pressure acts via the thrust bearing on the rotation plate to urge the rotation plate toward the cylinder. As a result, the gap between the rotation plate and the cylinder is reduced, while a friction resistance offered to the rotation plate is reduced, thereby permitting the smooth rotation of the rotation plate.

13 Claims, 14 Drawing Sheets

VARIABLE CAPACITY VANE COMPRESSOR

BACKGROUND OF THE INVENTION

1. Field of the Invention

This invention relates to a variable capacity vane compressor which is capable of varying the delivery quantity or capacity of the compressor.

2. Description of the Prior Art

A conventional variable capacity compressor has been proposed e.g. by Japanese Provisional Patent Publication (Kokai) No. 63-259190, which includes a hollow cylinder formed within a housing, a rotor rotatably received within the hollow cylinder, a pair of side blocks fixed to respective opposite ends of the cylinder for closing same, and a plurality of vanes slidably fitted within respective slits formed in the rotor for dividing the space formed between the inner peripheral surface of the hollow cylinder and the outer peripheral surface of the rotor into a plurality of compression chambers, each of the plurality of compression chambers being caused to communicate with alternate ones of an inlet port and an outlet port, for drawing a refrigerant gas therein, compressing the refrigerant gas, and discharging the compressed refrigerant gas therefrom. The vane compressor has a rotation plate rotatably arranged between one of the pair of side blocks, i.e. a front side block, and the rotor, for controlling the maximum capacity of each compression chamber when it is shut off from the outside, and a spool slidably received within a spool-receiving chamber formed in the front side block, the spool having a pin of the rotation plate engaged therein, with the spool-receiving chamber being divided by the spool into a first pressure chamber into which is introduced the refrigerant gas at pressure corresponding to delivery pressure and a second pressure chamber into which is introduced an oil at pressure corresponding to delivery pressure via a valve mechanism which utilizes suction pressure, whereby as a result of the conflict between the pressures in the first and second pressure chambers, the rotation plate is driven for rotation. On the other hand, a sealing portion is provided between the rotation plate and the front side block for separation of upper and lower pressure regions from each other, while a supply passage is provided for communication with the sealing portion to supply an oil at pressure corresponding to the delivery pressure to the sealing portion.

In general, in the variable capacity vane compressor of this kind, when the gap between the rotation plate and the cylinder becomes large, the amount of blow-by gas leaking from the compression chambers in the hollow cylinder via the gap increases to lower compression efficiency (volume efficiency $\eta v$), the vane back pressure acting on the vanes decreases to cause chattering of vanes, and/or noise is produced through play of the rotation plate. Therefore, it is required to press the rotation plate against the cylinder.

In the proposed variable capacity vane compressor, to prevent leakage of the refrigerant gas introduced into the first pressure chamber, which is at pressure corresponding to the delivery pressure, the sealing portion (an annular groove and a seal ring fit therein) is provided between the rotation plate and the front side block for sealed separation or shutting-off of the upper-pressure and lower-pressure regions from each other, and is supplied with a lubricating oil at pressure corresponding to the delivery pressure. As a result, the lubricating oil exerts high pressure corresponding to the delivery pressure directly on the rotation plate to press same against the cylinder side.

However, to sufficiently prevent leakage of the refrigerant gas introduced into the first pressure chamber, which is at pressure corresponding to the delivery pressure, with aid of the seal ring and the lubricating oil, it is required to press the seal ring against the rotation plate to such an extent as will prevent the lubricating oil from leaking between the seal ring and the rotation plate. Accordingly, the frictional force occurring between the seal ring and the rotation plate offers a large resistance against the rotation of the rotation plate, thereby preventing smooth rotation of the rotation plate.

SUMMARY OF THE INVENTION

It is an object of the invention to provide a variable capacity vane compressor which is capable of preventing an increase in the gap between a rotation plate and a hollow cylinder while maintaining smooth rotation of the rotation plate.

To attain the object, the present invention provides a variable capacity vane compressor including a hollow cylinder having an inner peripheral surface with a substantially elliptic cross-section, a rotor rotatably received within the hollow cylinder, the rotor having an outer peripheral surface and a plurality of vane slits formed in the outer peripheral surface, a pair of side blocks secured to opposite ends of the hollow cylinder for closing the hollow cylinder, the pair of side blocks having inner end surfaces facing the hollow cylinder, respectively, one of the inner end surfaces of the pair of side blocks being formed with an annular recess, at least one compression space defined by the inner peripheral surface of the cylinder, the outer peripheral surface of the rotor, and the inner end surfaces of the pair of side blocks, a plurality of vanes radially slidably fitted in the plurality of vane slits, respectively, a rotation plate received within the annular recess formed in the one of the inner end surfaces of the pair of side blocks for rotation between the minimum load position which sets the delivery quantity of the compressor to the minimum, and the maximum load position which sets the delivery quantity of the compressor to the maximum, a suction chamber into which a refrigerant gas is drawn in, and a drive mechanism responsive to suction pressure within the suction chamber for driving the rotation plate for rotation.

The variable capacity vane compressor according to the invention is characterized by comprising:

- a thrust bearing arranged on an end face of the rotation plate on a side remote from the hollow cylinder;
- an annular pressing member arranged in the one of the side blocks and abutting on the end face of the rotation plate on the side remote from the hollow cylinder via the thrust bearing; and
- a high pressure-introducing passage for introducing high pressure to an end face of the annular pressing member on a side remote from the rotation plate, to thereby urge the annular pressing member toward the thrust bearing.

According to the present invention, since the annular piston abuts on the end face of the rotation plate on the side remote from the hollow cylinder via the thrust bearing, and the high pressure is introduced to the end face of the annular pressing member on the side remote from the rotation plate via the high pressure-introducing passage. Therefore, the high pressure acts via the thrust bearing on the rotation plate to press the rotation plate against the cylinder. As a result, it is possible to prevent the gap between the rotation plate and the cylinder from increasing, with a reduced friction resistance offered to the rotation plate, thereby permitting smooth rotation of the rotation plate.

Preferably, the high pressure is delivery pressure of the refrigerant gas discharged from the compression space.

According to this preferred embodiment, the delivery pressure discharged, as the high pressure, from the compression space in the cylinder acts on the end face of the annular pressing member on the side remote from the cylinder. Therefore, even in the minimum load condition, the pressure acting on the rotation plate via the thrust bearing does not drop largely, thereby holding the force pressing the rotation plate against the cylinder at a high level, to keep small the gap between the rotation plate and the cylinder.

Preferably, a delivery pressure-introducing chamber is provided at an intermediate portion of the high pressure-introducing passage, for attenuating variation in pressure of the refrigerant gas.

According to this preferred embodiment, variation of the pressure of the refrigerant gas introduced from the compression space via the high pressure-introducing passage to the end face of the pressing member on the side remote from the rotation plate is attenuated by the delivery pressure-introducing chamber, whereby the pulsation of the pressure is reduced, and the delivery pressure substantially at a constant level is introduced via the high pressure-introducing passage to the end face of the annular pressing member on the side remote from the rotation plate irrespective of variation in the capacity of the compressor, which makes it possible to keep constant the urging force for pressing the rotation plate against the cylinder.

Preferably, the drive mechanism comprises a control pressure chamber in which control pressure is developed, a piston responsive to variation in the control pressure for performing reciprocating motion to rotate the rotation plate, a high pressure chamber into which is introduced delivery pressure discharged from the compression space, a first restriction passage communicating between the control pressure chamber and the high pressure chamber, and a pressure control valve mechanism responsive to the suction pressure for controlling the state of communication between the suction chamber and the high pressure chamber to thereby vary the control pressure according to the suction pressure.

Preferably, the variable capacity vane compressor includes:

a back pressure chamber facing the end face of the annular pressing member on the side remote from the rotation plate; and a second restriction passage communicating between the high pressure chamber and the back pressure chamber, the second restriction passage being smaller in diameter than the first restriction passage.

According to this preferred embodiment, in a transient operating condition of the compressor wherein the rotational speed thereof suddenly drops so that the control pressure and the back pressure increase through cut-off of the communication between the high pressure chamber and the low pressure chamber, the back pressure developed within the back pressure chamber becomes lower than the control pressure developed within the control pressure chamber, thereby reducing the sliding resistance or friction between the rotation plate and the cylinder. Therefore, the catching phenomenon does not occur, which would otherwise occur when the rotational speed of the compressor suddenly drops, thereby making it possible to always keep the suction pressure substantially constant.

Preferably, the capacity of the back pressure chamber is larger than the capacity of the control pressure chamber when the rotation plate is positioned in the minimum load position.

According to this preferred embodiment, a difference between the control pressure and the back pressure is positively developed, which makes it possible to perform variable capacity control in an even more stable manner.

Preferably, the variable capacity vane compressor includes:

a back pressure chamber the end face of the annular pressing member on the side remote from the rotation plate; and a second restriction passage communicating between the high pressure chamber and the back pressure chamber, wherein delivery pressure within the high pressure chamber is introduced to the back pressure chamber via the first restriction passage, the control pressure chamber, and the second restriction.

According to this preferred embodiment, in a transient operating condition of the compressor wherein the rotational speed thereof suddenly drops so that the control pressure and the back pressure increase through cut-off of the communication between the high pressure chamber and the low pressure chamber, the back pressure developed within the back pressure chamber becomes lower than the control pressure developed within the control pressure chamber, thereby reducing the sliding resistance or friction between the rotation plate and the cylinder. Therefore, the catching phenomenon does not occur, which would otherwise occur when the rotational speed of the compressor suddenly drops, thereby making it possible to always keep the suction pressure substantially constant.

Preferably, the second restriction passage is smaller in diameter than the first restriction passage.

According to this preferred embodiment, a difference between the control pressure and the back pressure is positively developed, which makes it possible to perform variable capacity control in an even more stable manner.

The above and other objects, features, and advantages of the invention will become more apparent from the following detailed description taken in conjunction with the accompanying drawings.

DESCRIPTION OF THE PREFERRED EMBODIMENTS

Figure 1:
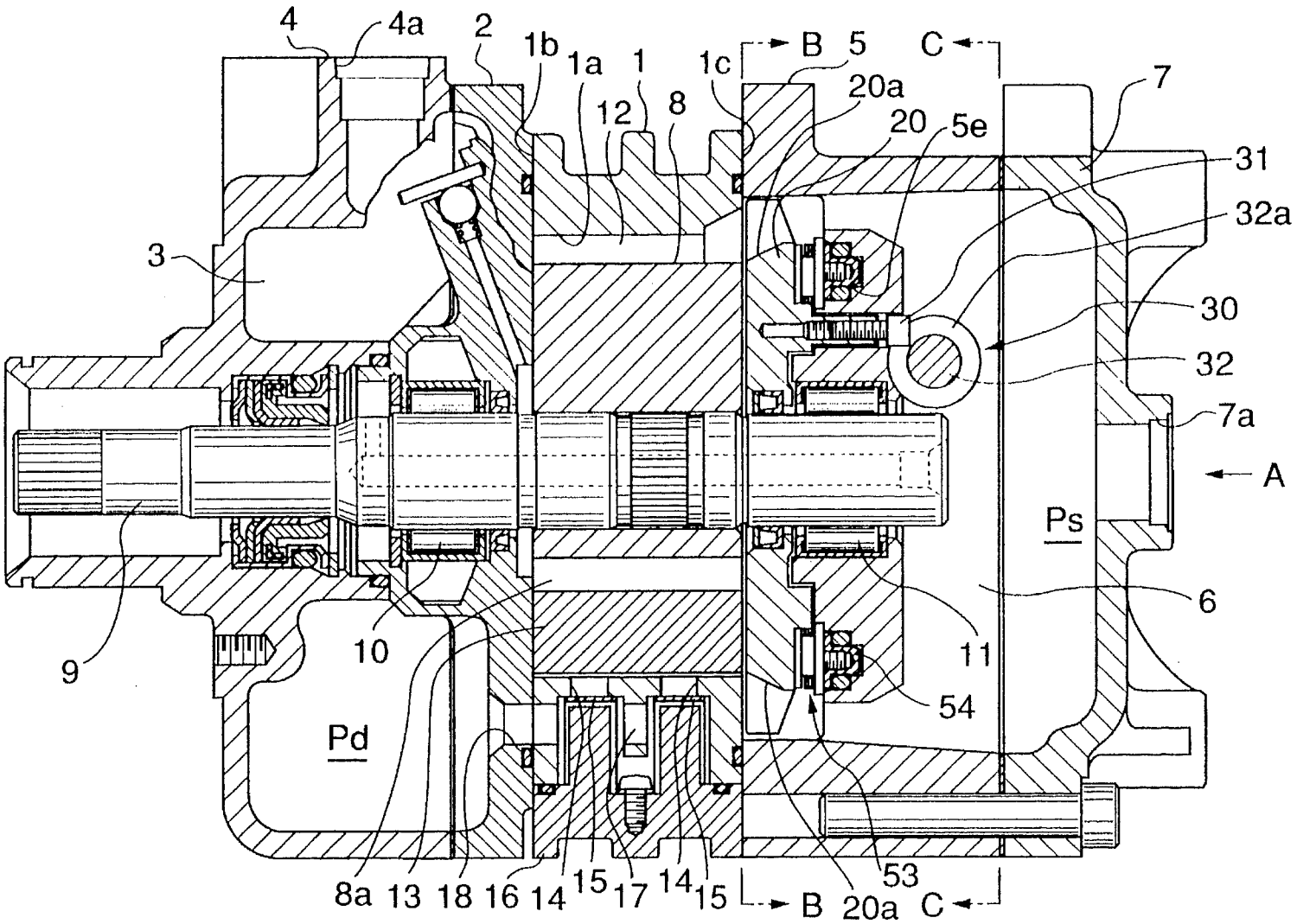
FIG. 1 is a longitudinal cross-sectional view showing a variable capacity vane compressor according to a first embodiment of the invention.

Next, the present invention will be described in detail with reference to drawings showing embodiments thereof;

Referring first to FIG. 1, there is shown a variable capacity vane compressor according to a first embodiment of the invention. The variable capacity vane compressor is comprised of a hollow cylinder 1 having an internal peripheral surface 1*a* with generally elliptical cross-section, a front side block 2 fixed to a front side end 1*b* of the hollow cylinder 1, a front head 4 secured to an end of the front side block 2 for defining a discharge pressure chamber 3 therebetween, a rear side block 5 fixed to a rear side end 1*c* of the hollow cylinder 1, a rear head 7 secured to an end of the rear side block 5 for defining a suction chamber 6 therebetween, a rotor 8 rotatably received within the hollow cylinder 1, and a rotation shaft 9 on which the rotor 8 is rigidly fitted.

The rotation shaft 9 is rotatably supported by radial bearings 10, 11 arranged in the front side block 2 and the rear side block 5, respectively.

A discharge port 4*a* is formed in an upper wall of the front head 4 for discharging a refrigerant gas therethrough, while a suction port 7*a* is formed through a wall of the rear head 7 for drawing in the refrigerant gas therethrough. The discharge port 4*a* communicates with the discharge pressure chamber 3, while the suction port 7*a* with the suction chamber 6.

A pair of compression spaces 12, 12 are defined at diametrically opposite locations between the inner peripheral surface 1*a* of the hollow cylinder 1 and the outer peripheral surface of the rotor 8. The rotor 8 has its outer peripheral surface formed therein with a plurality of axial vane slits 8*a* at circumferentially equal intervals, in each of which a vane 13 is radially slidably fitted.

The two compression spaces 12 are divided by the vanes 13, which rotate in sliding contact with the inner peripheral surface of the hollow cylinder, into a plurality of compression chambers variable in capacity.

As shown in FIG. 1, refrigerant outlet ports 14, 14 are formed through opposite lateral side walls of the hollow cylinder 1 at diametrically opposite locations (in FIG. 1, one of them is shown). A discharge valve 15 is provided for each of the outlet ports 14. Further, between the outer peripheral surface of the cylinder 1 and discharge valve covers 16 secured thereto, there are defined discharge spaces 17 into which flows the compressed refrigerant gas discharged via the outlet ports 14. The discharge spaces 17 communicate with the discharge pressure chamber 3 via discharge passages 18 formed in the front side block 2.

Figure 3:
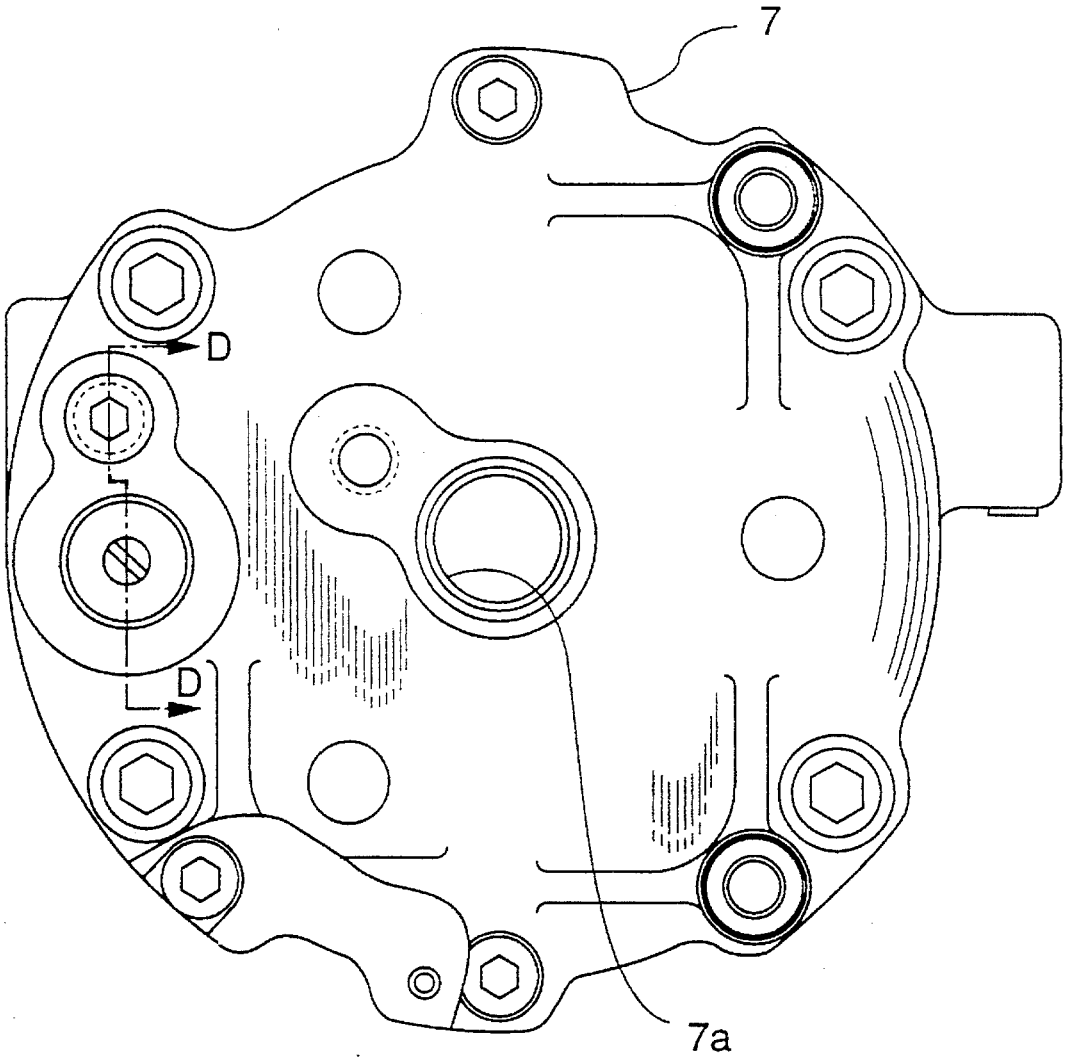
FIG. 3 is an end view of the FIG. 1 compressor as viewed in the direction of an arrow A.

FIG. 3 shows a rear end face of the rear head 7 as viewed in the direction of an arrow A in FIG. 1.

Figure 6:
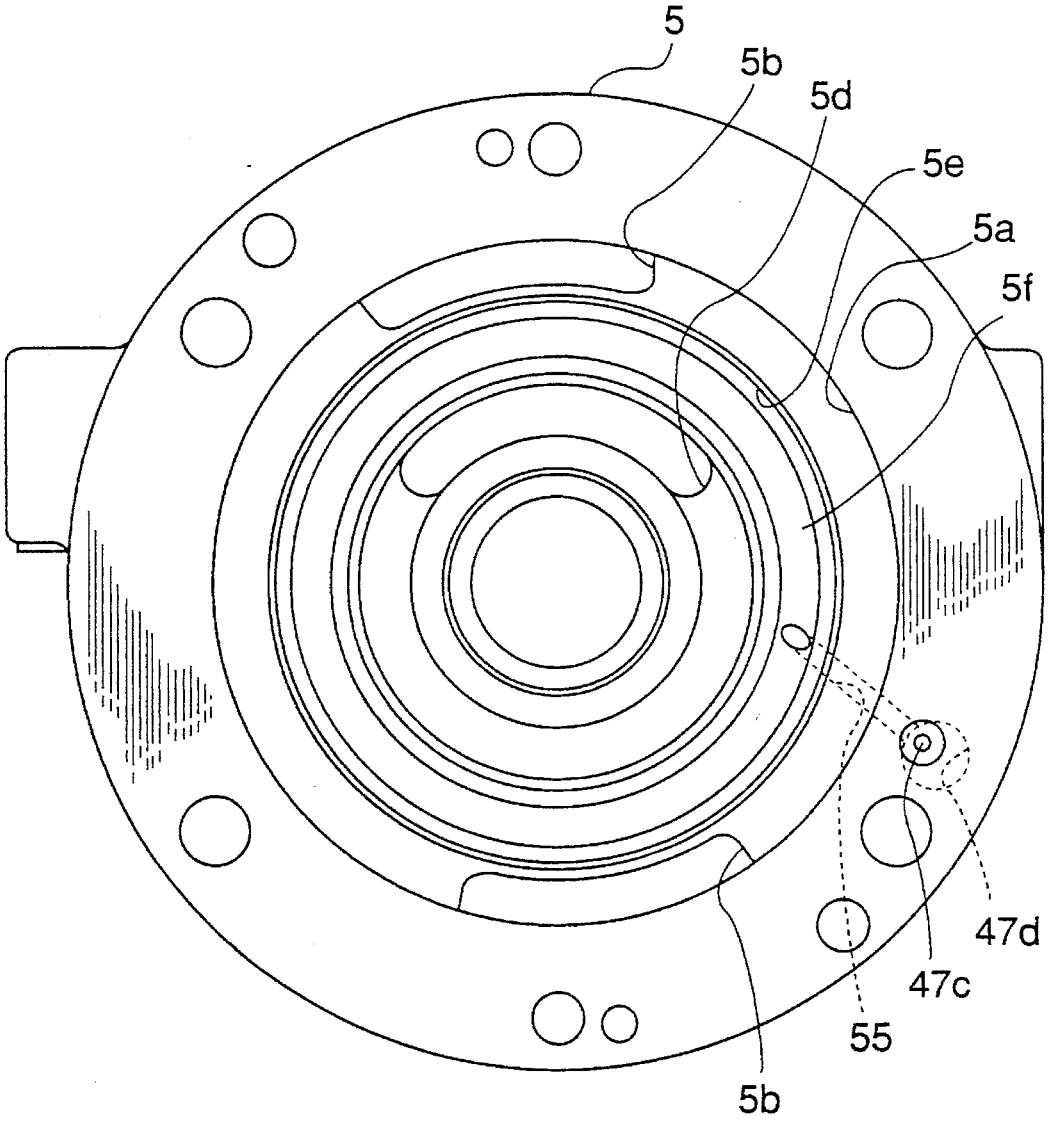
FIG. 6 is an end view of a rear side block taken along line B—B of FIG. 1.
Figure 7:
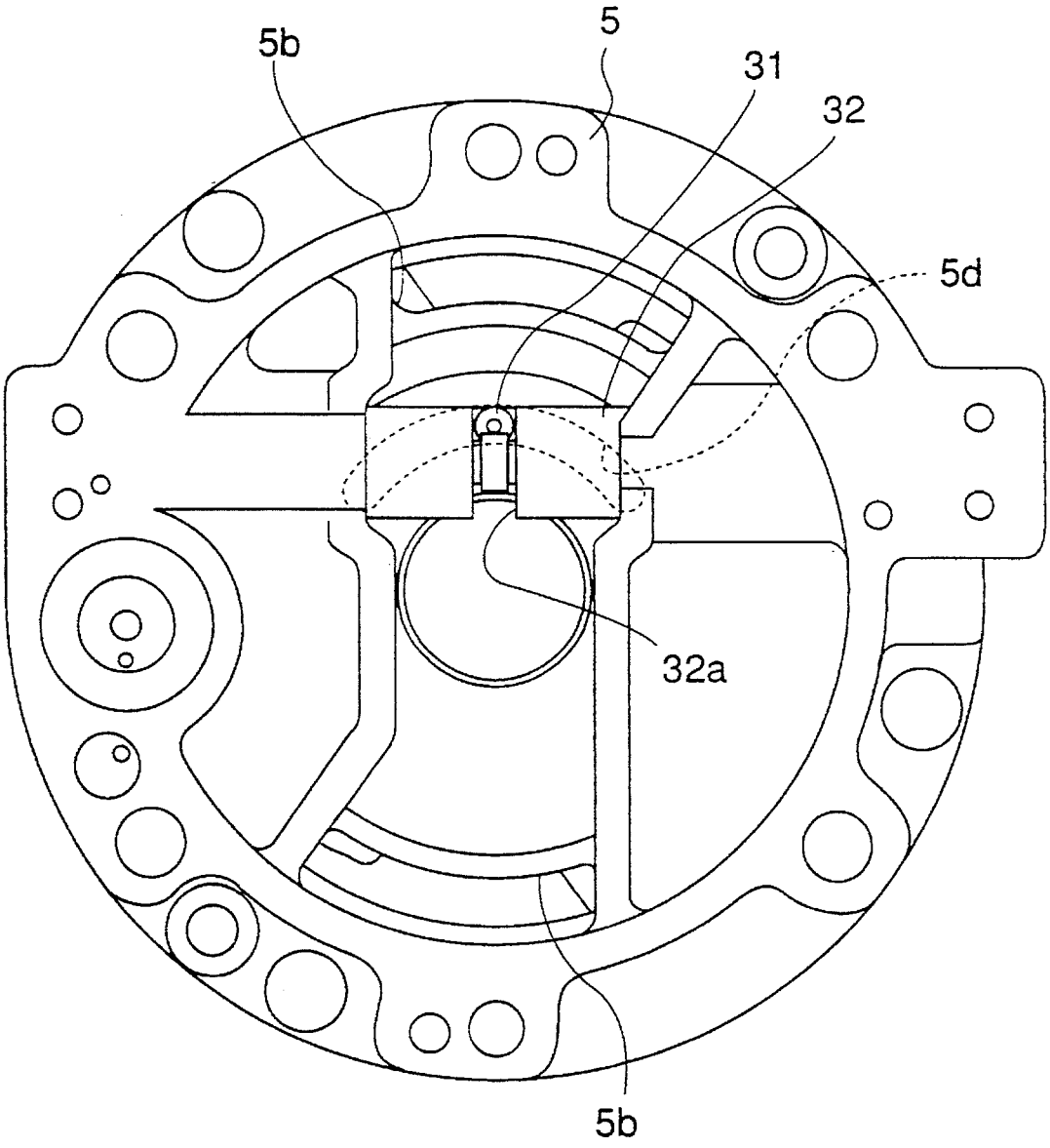
FIG. 7 is a view taken along line C—C of FIG. 1, which shows a state in which a piston is in the minimum load position.

FIG. 6 shows one end face of the rear side block 5 as viewed in the direction of arrows B in FIG. 1, while FIG. 7 shows the other end face of the rear side block 5 as viewed in the direction of arrows C in FIG. 1, in a state in which a piston 32, referred to hereinafter, is in the medium load position.

The one end face of the rear side block facing the cylinder 1 is formed with an annular recess 5*a*, as shown in FIG. 6. A rotation plate 20 is received in the annular recess 5*a*. The rotation plate 20 is driven by a drive mechanism 30, referred to hereinafter.

Two refrigerant inlet ports 5*b* are formed in the rear side block 5 at diametrically opposite locations. On the other hand, the rotation plate 20 is formed with two cut-out portions 20*a* at diametrically opposite locations. The refrigerant gas in the suction chamber 6 is drawn into the compression spaces 12 via the refrigerant inlet ports 5*b* in the rear side block 5 and the cut-out portions 20*a* in the rotation plate 20, respectively.

The rotation plate 20 received in the annular recess 5*a* can be rotated between the minimum load position at which the position of the rotation plate 20 determining timing of termination of the suction stroke for drawing in the refrigerant gas via the refrigerant inlet ports 5*b* and the cut-out portions 20*a* (start of the compression stroke) is set to a most retarded position thereby minimizing the delivery quantity or capacity of each compression chamber, and the maximum load position at which the position of the rotation plate 20 determining timing of termination of the suction stroke is set to a most advanced position thereby maximizing the delivery quantity or capacity of each compression chamber. Thus, it is possible to continuously vary the delivery quantity or capacity of each compression chamber.

Figure 8:
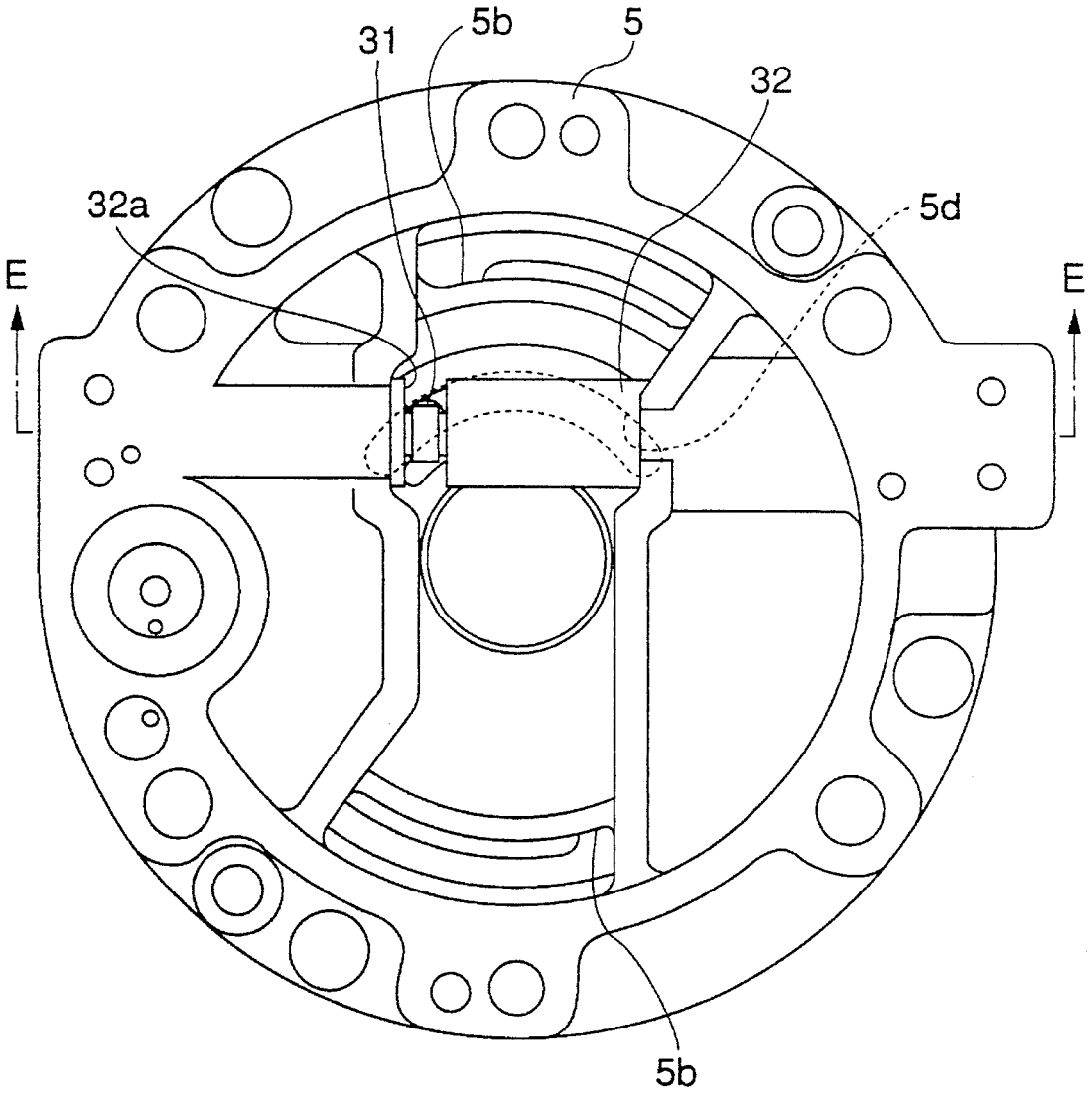
FIG. 8 is a view similar to FIG. 7, which shows a state in which the piston is in the medium load position.

FIG. 8 shows the other end face of the rear side block 5 similarly to FIG. 7, in a state in which the piston 32 is in the medium load position.

Figure 4:
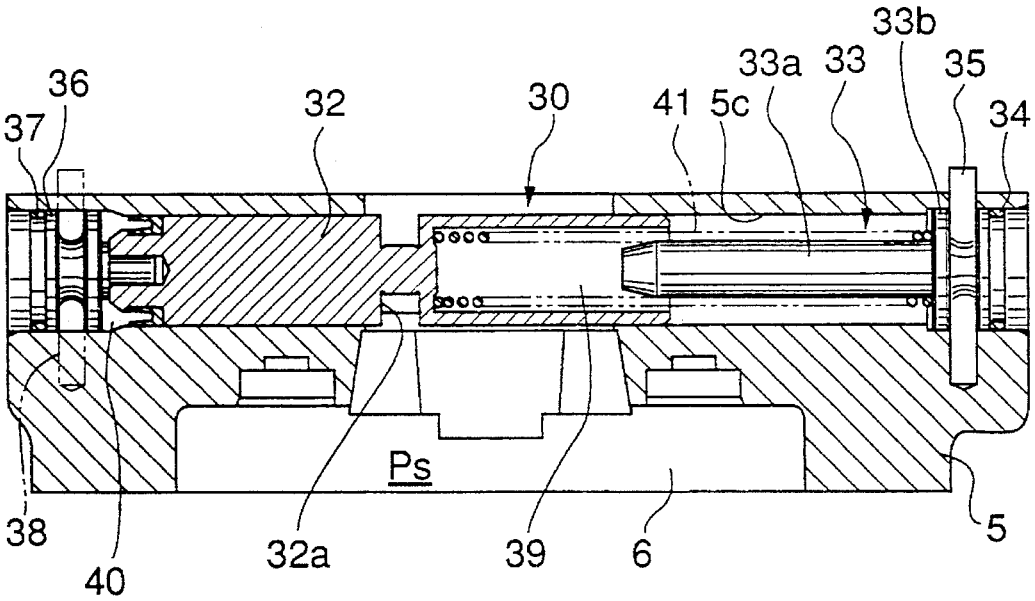
FIG. 4 is a cross-sectional view taken along line E—E of FIG. 8.
Figure 5:
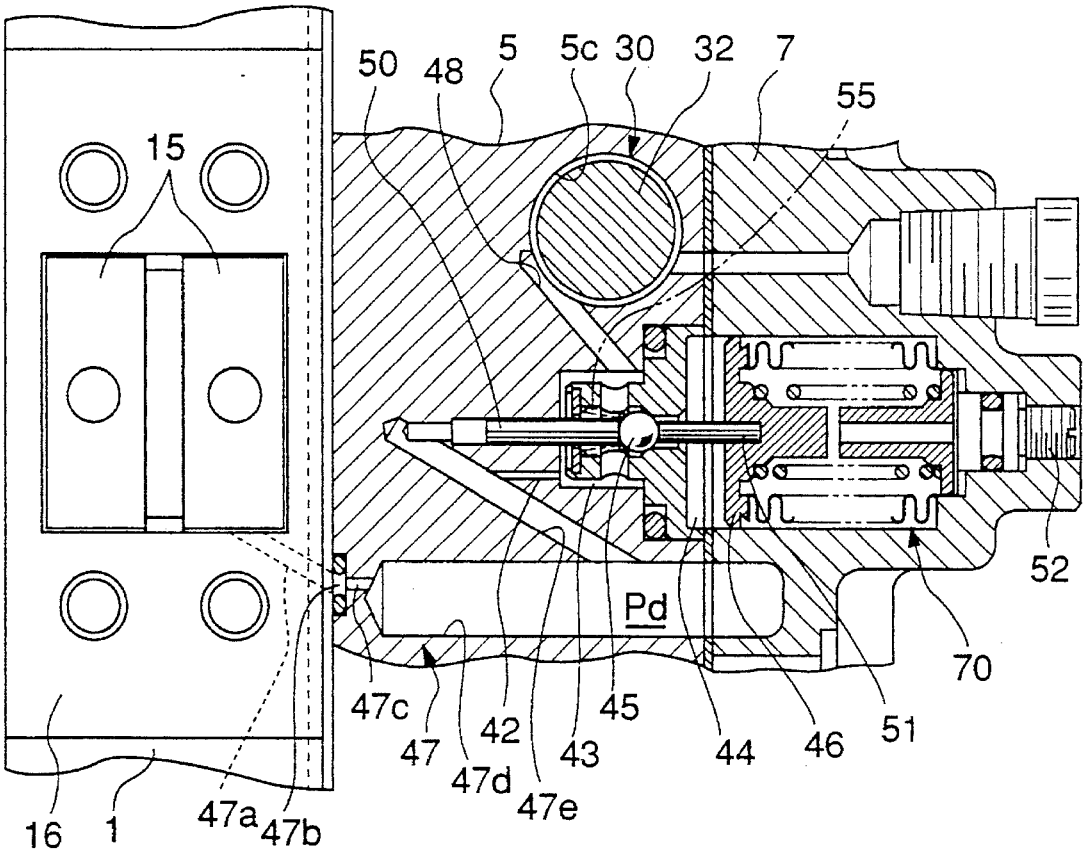
FIG. 5 is a cross-sectional view taken along line D—D of FIG. 3.

FIG. 4 shows a cross-section of the rear side block 5 taken along line E—E of FIG. 8, while FIG. 5 shows a fragmentary cross-section taken along line D—D of FIG. 3.

The drive mechanism 30 is slidably received in a cylinder chamber 5*c* formed in the rear side block 5, and is mainly comprised of the aforementioned piston 32 engaged with a connection pin 31 (see FIG. 1) fixed to the rotation plate 20, for rotating the rotation plate 20, and a pressure control mechanism 70 for controlling the reciprocating movement of the piston 32. The connecting pin 31 projects toward the rear head 7 and has an open end thereof engaged in an annular groove 32*a* formed around the periphery of the piston 32 as shown in FIG. 1 and FIG. 7, and also slidably engaged in an arcuate guide opening 5*d* formed in the rear side block 5. This permits the piston 32 to perform reciprocating movement within the cylinder chamber 5*c*, to cause the open end of the connecting pin 31 to slide in the arcuate guide opening 5*d*, thereby rotating the rotation plate 20.

As shown in FIG. 4, a spring guide member 33 having a guiding portion 33*a* in the form of a rod is inserted into the cylinder chamber 5*c* at one end thereof, with the one end of the cylinder chamber 5*c* is being air-tightly closed by a spring-receiving block 33*b* of the spring guide member 33 and an O ring 34. The spring-receiving portion 33*b* is fixed to the rear side block 5 by a pin 35. On the other hand, the other end of the cylinder chamber 5*c* is air-tightly closed by a plug 36 and an O ring 37. The plug 36 is fixed to the rear side block 5 by a pin 38.

A low pressure chamber 39 is defined between one end face of the piston 32 and the inner end face of the spring-receiving block 33*b* of the spring guide member 33, for introducing therein suction pressure Ps prevailing within the suction chamber 6. A control pressure chamber 40 is defined between the other end face of the piston 32 and the inner end face of the plug 36, for introducing therein control pressure Pc, referred to hereinafter. The piston 32 is urged toward the minimum load position thereof at which the delivery quantity is minimized (leftward as viewed from FIG. 4) by the sum of the urging force of a spring 41 interposed between the one end of the piston 32 and the spring-receiving block 33*b* of the spring guide member 33, and the suction pressure Ps introduced into the low pressure chamber 39, while it is urged toward the maximum load position thereof at which the delivery quantity is maximized (rightward as viewed from FIG. 4) by the control pressure Pc introduced into the control pressure chamber 40. As a result, the piston 32 performs reciprocating movement in the cylinder chamber 5*c* according to variation in the control pressure PC. That is, the piston 32 is displaced toward the full load position when the control pressure Pc exceeds the suction pressure Ps plus the urging force of the spring 41, while it is displaced toward the minimum load position when the former becomes lower than the latter.

The pressure control mechanism 70 operates to vary the control pressure Pc introduced into the control pressure chamber 40 in response to the suction pressure Ps prevailing within the suction chamber 6. As shown in FIG. 5, the pressure control mechanism 70 is comprised of a ball valve 45 for opening and closing a communication passage connecting between a high pressure chamber 43 and a bellows chamber 44, a spring 55 for urging the ball valve 45 in a valve-closing direction, a plunger 50 responsive to the delivery pressure Pd introduced via a high pressure communication passage 47 for urging the ball valve 45 in a valve-closing direction, a bellows 46 received in the bellows chamber 44 into which the suction pressure Ps is introduced from the suction chamber 6, for expansion and contraction of the bellows 46 in response to variation in the suction pressure Ps thus prevailing within the bellows chamber 44, and a rod 51 secured to a free end of the bellows 46 for urging the ball valve 45 in the valve-opening direction when the bellows 6 expands.

The high pressure-introducing passage 47 is formed by a communication passage 47*a* formed in the cylinder 1, and a port 47*b*, a communication passage 47*c*, a delivery pressure-introducing chamber 47*d* having a large capacity, and a communication passage 47*e*, all formed in the rear side block 5. The communication passage 47*a* directly communicates with the discharge space 17 (see FIG. 1) into which the refrigerant gas is discharged from the compression space 12. The communication passage 47*e* communicates with the high pressure chamber 43 via an orifice 42 through which the refrigerant gas discharged from the compression space 12 is introduced into the high pressure chamber 43 to develop the control pressure Pc therein.

Further, the high pressure chamber 43 communicates with the control pressure chamber 40 (see FIG. 4) via a communication passage 48 through which the control pressure Pc developed within the high pressure chamber 43 is introduced into the control pressure chamber 40.

When the suction pressure Ps becomes lower than a predetermined value, the bellows 46 expands from a state shown in FIG. 5 to open the ball valve 45, thereby decreasing the control pressure Pc within the high pressure chamber 43 and the control pressure chamber 40, whereas when the former become higher than the latter, the bellows contracts to the state as shown in FIG. 5, thereby increasing the control pressure Pc in the high pressure chamber 43 and the control pressure chamber 40. The predetermined value can be adjusted by an adjusting screw 52.

Figure 2:
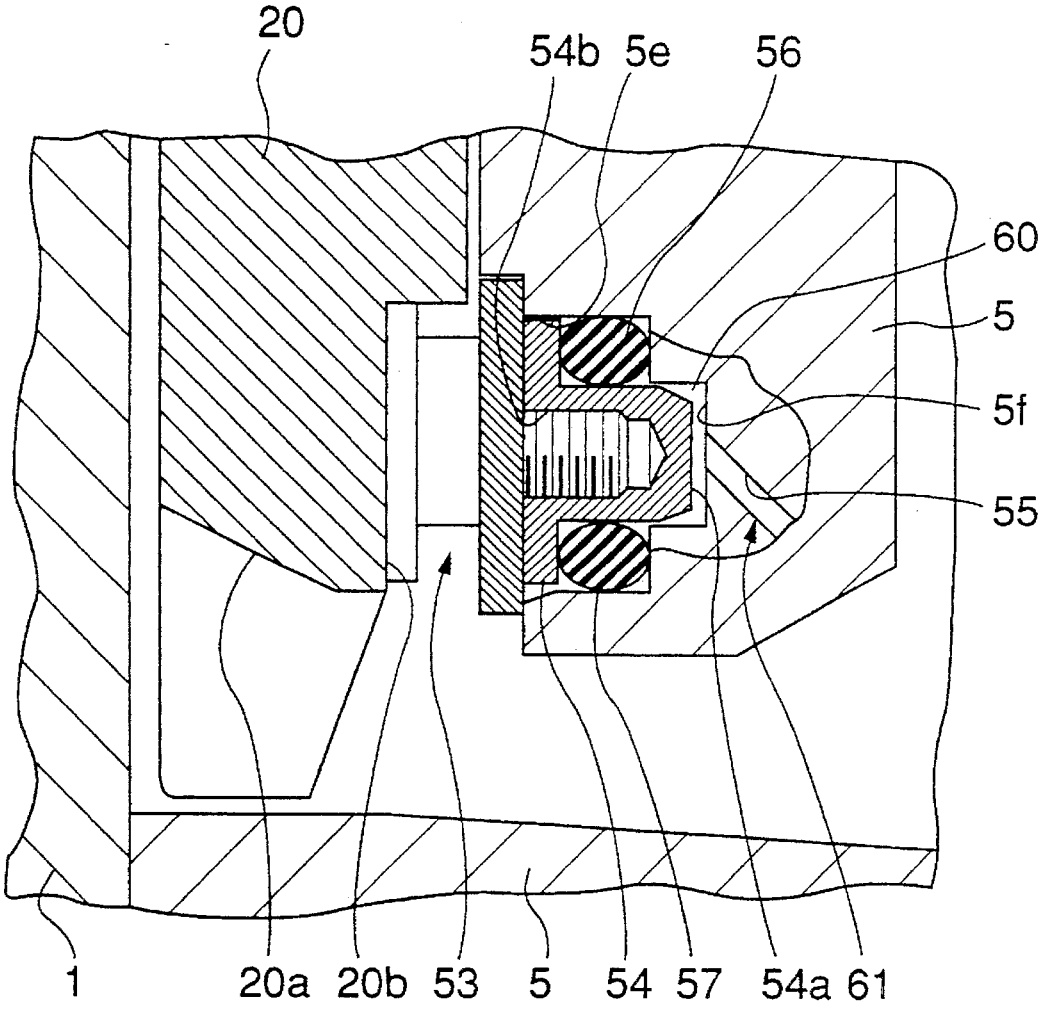
FIG. 2 is a fragmentary enlarged view showing part of the FIG. 1 compressor.

As shown in FIG. 2, an annular piston (annular pressing member) 54 is received within an annular recess 5*e* formed in the bottom of the annular recess 5*a* of the rear side block 5. The annular piston 54 abuts via a thrust bearing 53 on an end face 20*b* of the rotation plate 20 on the side remote from the cylinder 20.

Further, a back pressure chamber 60 is defined between the bottom face 5*f* of the annular recess 5*e* and an end face 54*a* of the annular piston 54 on the side remote from the rotation plate 54*a*, into which is introduced the delivery pressure Pd via a communication passage 55. The communication passage 55 is formed in the rear side block 5, one end of which opens into the delivery pressure-introducing chamber 47*d* (see FIG. 5) of the high pressure-introducing passage 47 and the other end of which opens into the bottom face 5*f* of the annular recess 5*e*. The communication passage 55, the port 47*b*, the communication passage 47*c*, and the delivery pressure-introducing chamber 47*d* form a high pressure-introducing passage 61 which permits the refrigerant gas discharged from the compression space 12 to be introduced into the back pressure chamber 60 (i.e. to the end face 54*a* of the annular piston 54 on the side remote from the rotation plate 20).

To prevent the delivery pressure Pd prevailing within the back pressure chamber 60 from leaking to the lower pressure side (the suction chamber 6 side), O rings 56 and 57 are provided between the annular piston 54 and the annular groove 5*e*. The annular piston 54 is formed with a female screw 54*b* for facilitating the removal thereof from the annular recess 5*e*.

Next, the operation of the variable capacity vane compressor according to the first embodiment will be described.

When the compressor is started, the control pressure Pc is low, so that the piston 32 is in the minimum load position as shown in FIG. 4, with the rotation plate 20 being also in the minimum load position, whereby the compressor is operated at a reduced capacity.

When the suction pressure Ps exceeds the predetermined value, the bellows 46 contracts as shown in FIG. 5 to cause the ball valve 45 to close, whereby the control pressure Pc prevailing in the high pressure chamber 43 and the control pressure chamber 40 increases, to displace the piston 32 from the minimum load position toward the maximum load position (rightward as viewed from FIG. 4). For example, the piston 32 is displaced from the minimum load position as shown in FIG. 8 to the medium load position shown in FIG. 7. This displacement is transmitted to the rotation plate 20 via the connecting pin 31, thereby turning the rotation plate 20 from the minimum load position toward the maximum load position, thereby increasing the delivery capacity.

When the suction pressure Ps becomes lower than the predetermined value, the bellows 46 expands from the state shown in FIG. 5 to cause the ball valve 45 to open, whereby the control pressure Pc in the high pressure chamber 43 and the control pressure chamber 40 decreases, displacing the piston 32 from the maximum load position to the minimum load position. The leftward displacement of the piston 32 as viewed from FIG. 4 is transmitted via the connection pin 31 to the rotation plate 20, whereby the rotation plate 20 is rotated from the maximum load position toward the minimum load position, thereby decreasing the delivery quantity.

Thus, the rotation plate 20 is rotated in response to the suction pressure Ps, to continuously vary the delivery quantity or capacity of the compressor.

According to the variable capacity vane compressor according to the first embodiment, the annular piston 54 is received in the annular recess 5*e* of the rear side block 5 and abuts on the end face 20*b* of the rotation plate 20 on the side remote from the cylinder 1 via the thrust bearing 53. The delivery pressure Pd, which is introduced to the end face 54*a* of the annular piston 54 on the side remote from the rotation plate 20, acts on the rotation plate 20 via the thrust bearing 53 to press the rotation plate 20 against the cylinder 1. Therefore, the friction resistance offered to the rotation plate 20 is reduced, thereby making it possible to maintain the smooth rotation of the ration plate 20, while preventing the gap between the rotation plate 20 and the cylinder 1 from increasing.

Further, the delivery pressure-introducing chamber 47*d* having a large capacity is provided at an intermediate location of the high pressure-introducing passage 61 for introducing the refrigerant gas discharged from the compression space 12 within the cylinder 1 into the back pressure chamber 60 (i.e. to the end face 54*a* of the annular piston 54 on the side remote from the annular piston 54). As a result, variation in the pressure of the refrigerant gas supplied from the compression space 12 via the high pressure-introducing passage 61 to the end face 54*a* of the annular piston 54 on the side remote from the rotation plate 54*a* is attenuated by the delivery pressure-introducing chamber 47*d*. This decreases pulsation of the pressure, thereby supplying the delivery pressure Pd at a substantially constant level Pd to the end face 54*a* of the annular piston 54 on the side remote from the rotation plate 20 via the high pressure-introducing passage 61 irrespective of change in the capacity of the compressor. This makes it possible to hold the gap between the rotation plate 20 and the cylinder 1 substantially constant irrespective of changes in the capacity of the compressor, while maintaining smooth rotation of the rotation plate 20.

Next, a variable capacity vane compressor according to a second embodiment of the invention will be described with reference to FIG. 9 to FIG. 12.

In the first embodiment, the back pressure chamber 60 communicates via the communication passage 55 with the delivery pressure-introducing passage 47*d* and at the same time the control pressure chamber 40 communicates with the high pressure chamber 43 via the communication passage 48. Therefore, the back pressure Pa (in the first embodiment, Pa=delivery pressure Pd) is always higher than the control pressure within the control pressure chamber 40. Further, in a variation of the first embodiment in which the back pressure chamber 60 communicates with the high pressure chamber 43 via a second restriction passage having a diameter larger than that of the communication passage (first restriction passage) 48, the back pressure Pa is always larger than the control pressure Pc.

In the first embodiment and the variation thereof, when the compressor is in a transient condition in which the rotational speed of the compressor is suddenly drops from a high rotational speed to a low rotational speed, a catching phenomenon occurs in which the piston cannot be displaced. As a result, it becomes impossible to vary the delivery quantity such that the suction pressure Ps become substantially constant (equal to setting suction pressure Po).

In such a transient condition of the compressor, the suction pressure Ps undergoes a transient change from the setting suction pressure Po. When the pressure control mechanism 70 cuts off the communication between the high pressure chamber 43 and the suction chamber 6 to thereby increase the control pressure Pc and the back pressure Pa, Pa (back pressure) ≧Pc (control pressure) holds, so that the force of the annular piston 54 acting on the rotation plate 20 against the cylinder 1 becomes excessively large, thereby increasing sliding resistance between the rotation plate 20 and the cylinder 1 to prevent smooth rotation of the rotation plate 20. This causes the catching phenomenon mentioned above.

Figure 14:
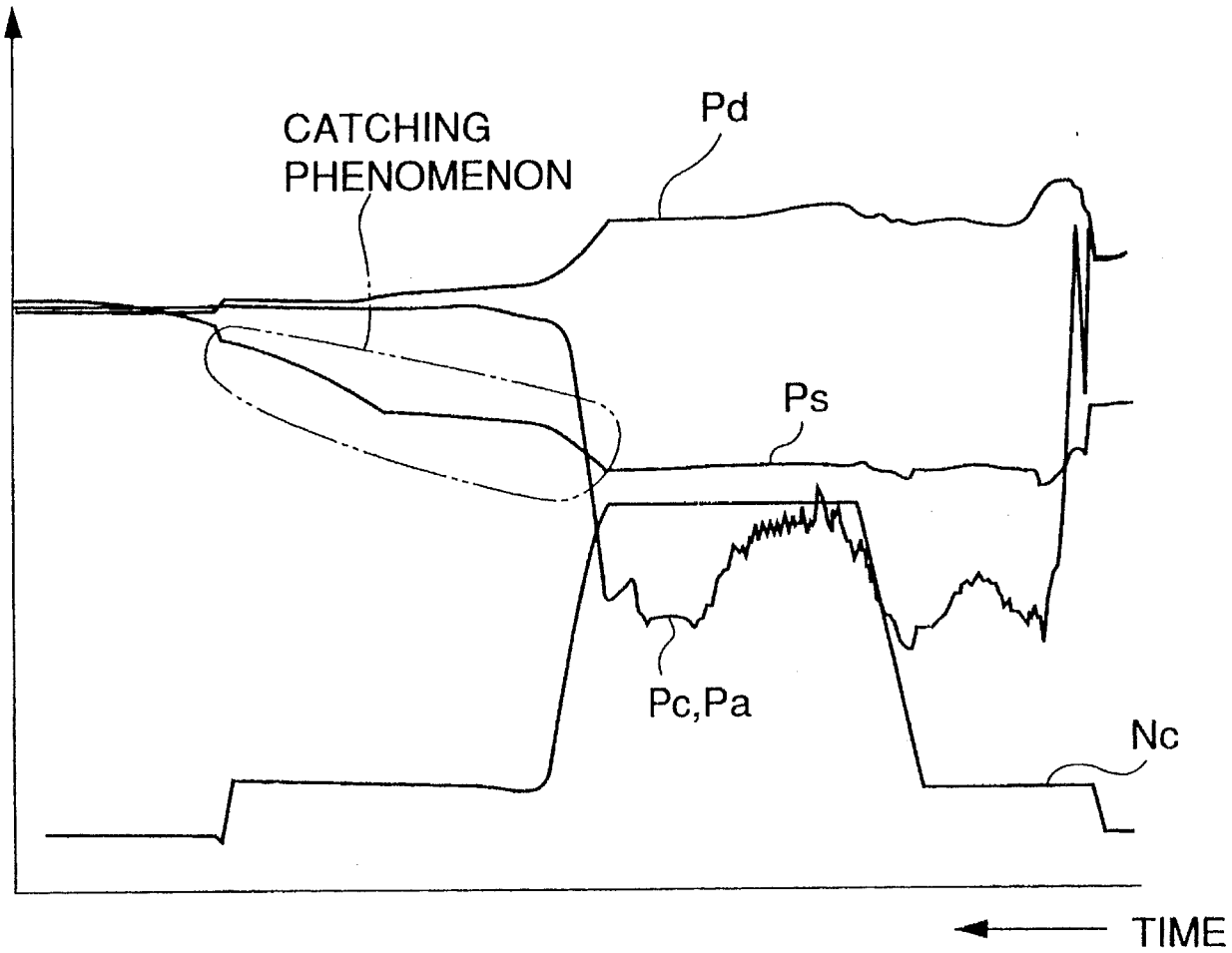
FIG. 14 is a diagram showing results of experiments conducted on a variation of the first embodiment.

FIG. 14 shows results of experiments conducted on the variation described above, with the diameter of the first restriction passage (communication passage 48) being set to approximately 2.0 mm, the diameter of the second restriction passage being set to approximately 2.5 mm, and the capacity of the back pressure chamber 60 being set to 1.84 $cm^3$. As can be understood from this figure, when the rotational speed Nc of the compressor suddenly drops from a high rotational speed to a low rotational speed, the suction pressure Ps, which is substantially controlled to a fixed value (setting suction pressure Po), undergoes a transient change (increase) with respect to the setting suction pressure Po. As a result, there arises the catching phenomenon as indicated by two-dot chain lines in the figure.

The variable capacity vane compressor according to the second embodiment provides an improvement of the first embodiment and the variation thereof that the catching phenomenon is prevented from occurring upon a sudden drop of the rotational speed, thereby making the suction pressure substantially constant.

Figure 9:
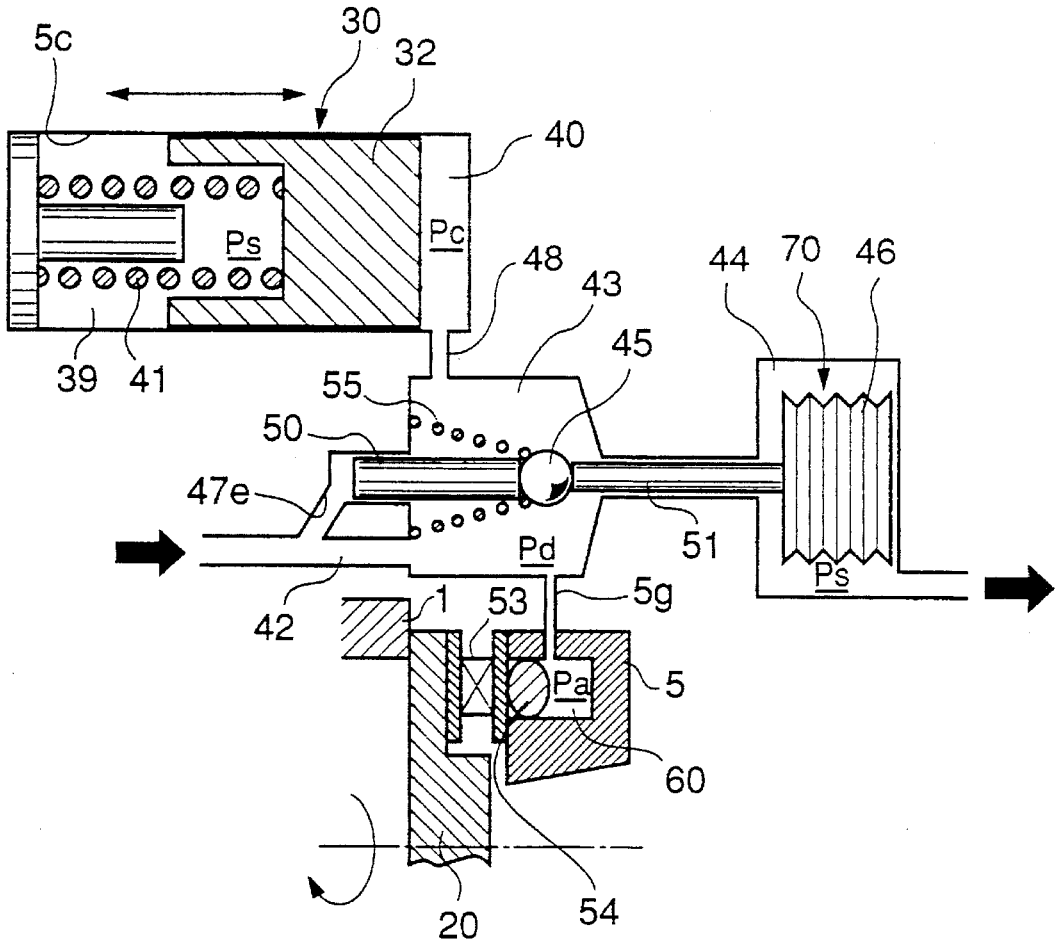
FIG. 9 is a conceptual representation showing essential parts of a variable capacity vane compressor according to a second embodiment of the invention.

FIG. 9 shows schematically shows essential parts and elements of the variable capacity vane compressor according to the second embodiment.

Figure 11:
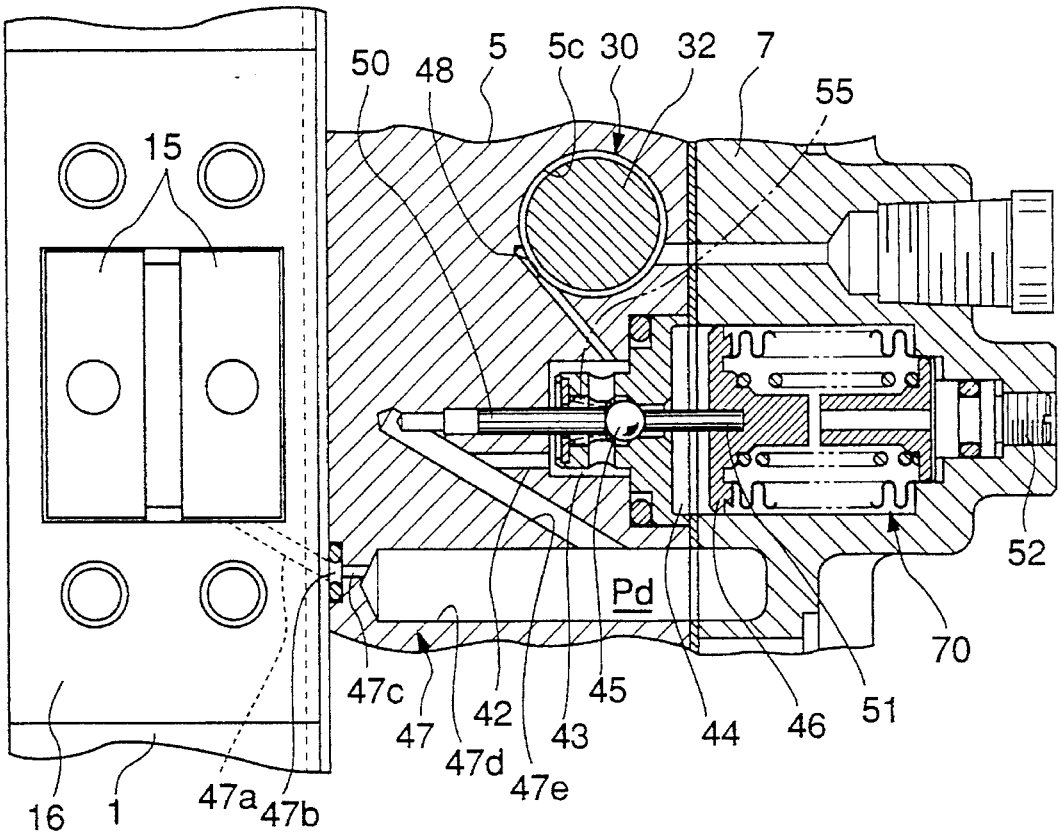
FIG. 11 is a cross-sectional view similar to FIG. 5, which shows part of the FIG. 10 compressor.

As shown in FIG. 9 and FIG. 11, the communication passage 47*e* communicates via a communication passage 42' having a diameter larger than that of the communication passage 42 of the first embodiment. This permits the delivery pressure Pd to be introduced into the high pressure chamber 43.

Further, the high pressure chamber 43 communicates with the control pressure chamber 40 via a Pc supply port (the first restriction passage) 48, and the delivery pressure Pd within the high pressure chamber 43 is restricted (in speed of propagation) by the Pc supply port 48 to thereby develop the control pressure Pc within the control pressure chamber 40.

Figure 10:
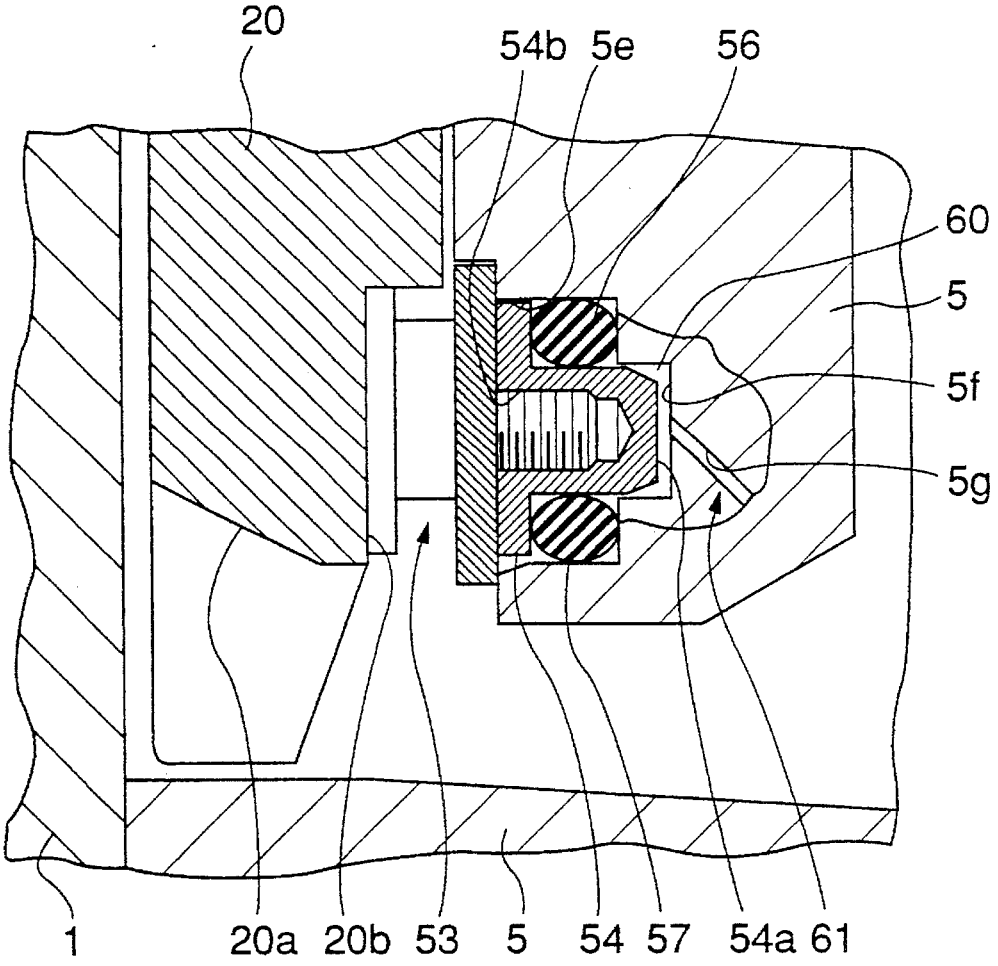
FIG. 10 is a fragmentary enlarged view similar to FIG. 2, which shows part of the variable capacity vane compressor according to the second embodiment.

As shown in FIG. 9 and FIG. 10, the back pressure chamber 60 communicates with the high pressure chamber 43 via a Pa supply port (the second restriction passage) 5*g* formed in the rear side block 5. This permits the delivery pressure Pd within the high pressure chamber 43 to be introduced into the back pressure chamber 60 to develop the back pressure Pa therein, while the delivery pressure Pd being restricted (in speed of propagation of the pressure) by the Pa supply port 5*g*.

The diameter of the Pa supply port 5*g* is set in advance to a value smaller than that of the Pc supply port 48, such that the back pressure Pa is lower than the control pressure Pc by a required difference, as the control pressure Pc and the back pressure Pa increase after the communication between the high pressure chamber 43 and the bellows 44 is cut off by the ball valve 45. For example, the diameter of the Pa supply port 5*g* is set to 0.3 mm, while the diameter of the Pc supply port 48 to 0.5

Further, to ensure that the back pressure Pa is lower than the control pressure Pc by the required difference, the capacity of the back pressure 60 is made larger than that of the control pressure chamber 40 in the minimum load position shown in FIG. 4. For example, the capacity of the back pressure chamber 60 is set to 3.5 $cm^3$.

According to the variable capacity vane compressor of the second embodiment, the diameter of the Pa supply port (the second restriction passage) 5g is made smaller than the diameter of the Pc supply port (first restriction passage) 48. Therefore, in a transient operating condition of the compressor wherein the rotational speed thereof suddenly drops, the back pressure Pa, which is developed within the back pressure chamber 60 when the control pressure Pc and the back pressure Pa increase through cut-off of the communication between the high pressure chamber 43 and the bellows chamber 44, becomes lower than the control pressure Pc developed within the control pressure chamber 40, thereby reducing the sliding resistance or friction between the rotation plate 20 and the cylinder 1.

Further, according to the second embodiment, the capacity of the back pressure chamber 60 is made larger than the capacity of the control pressure chamber 40 assumed when the piston 32 is in the minimum load position as shown in FIG. 4. Therefore, the back pressure Pa is positively made lower than the control pressure Pc by the required difference, thereby making it possible to perform the more stable capacity control.

Figure 12:
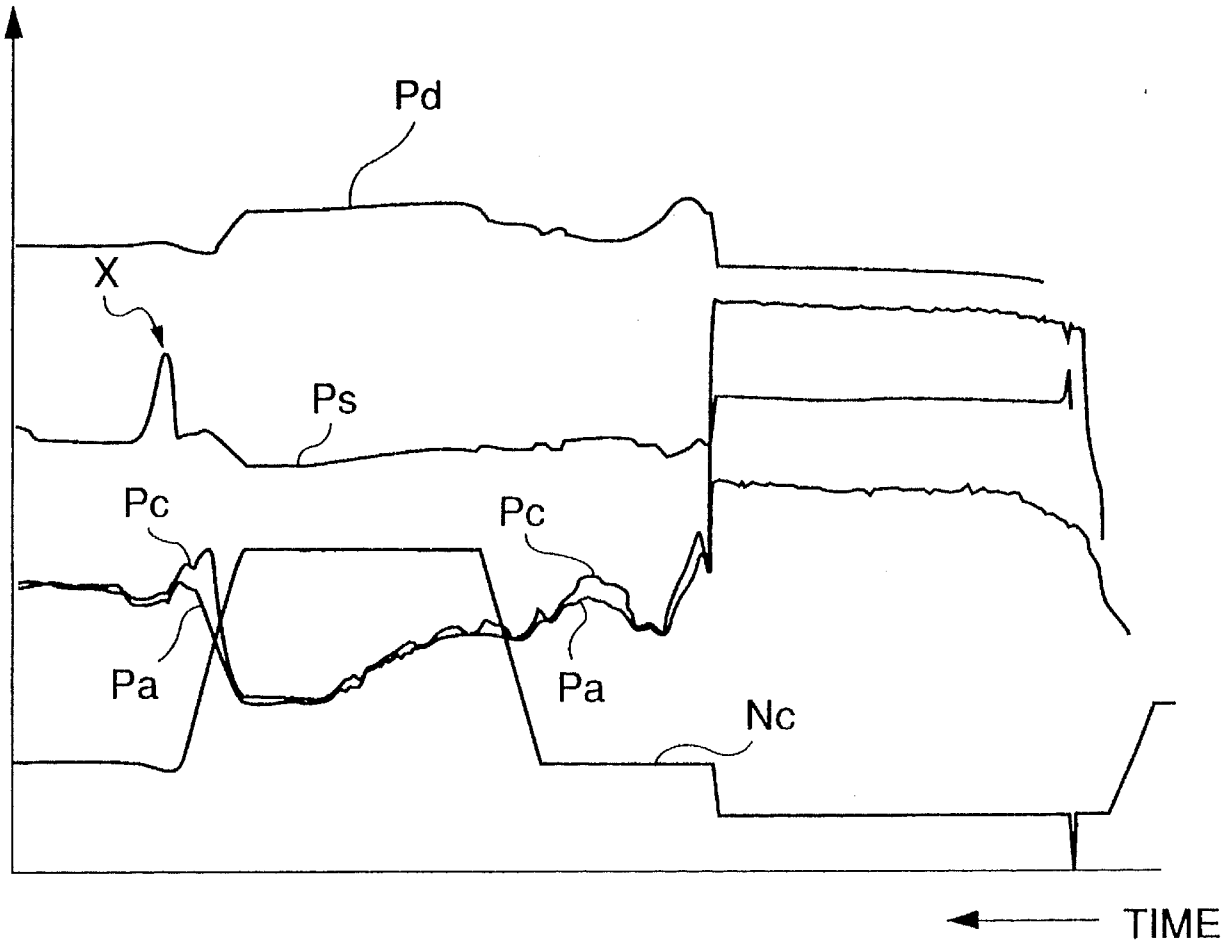
FIG. 12 is a diagram showing results of experiments conducted on the variable capacity vane compressor according to the second embodiment shown in FIG. 9 to FIG. 11.

FIG. 12 shows results of experiment conducted on the compressor of the second embodiment in which the diameter of the Pa supply port 5g is set to 0.3 mm, and the diameter of the Pc supply port is set to 0.5 mm, with the capacity of the back pressure chamber 60 being set to 3.5 $mm^3$. As is clear from the figure, when the rotational speed Nc suddenly drops from the high rotational speed, the suction pressure Ps substantially controlled to a fixed value slightly increases in a region designated by a symbol X in the figure, but thereafter it is substantially controlled to the fixed value (setting suction pressure Po). In short, the catching phenomenon indicated by the two dot-chain line shown in FIG. 4 does not occur.

Figure 13:
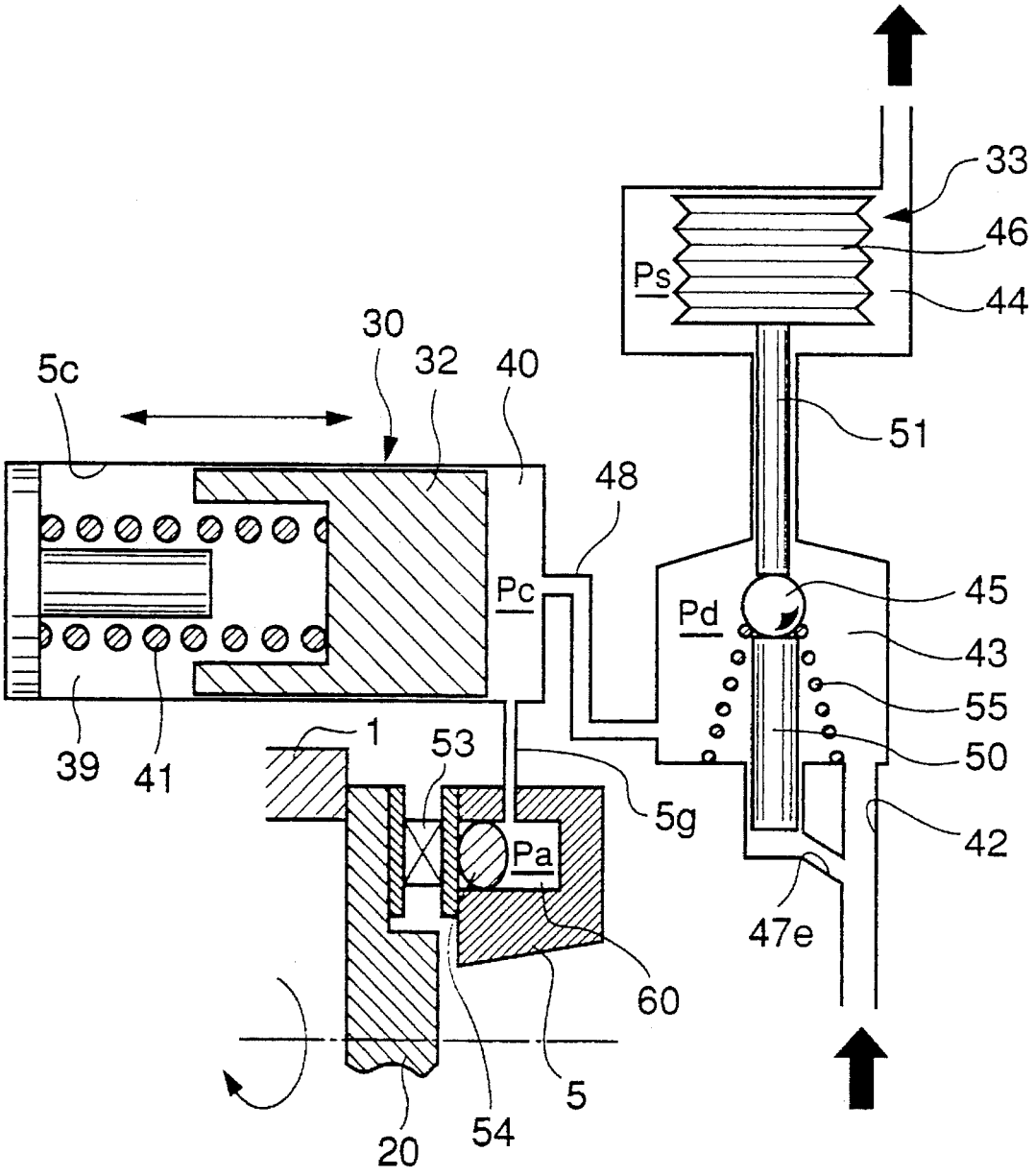
FIG. 13 a conceptual representation showing essential parts of a variable capacity vane compressor according to a third embodiment of the invention.

FIG. 13 schematically shows essential parts and elements of a variable capacity vane compressor according to a third embodiment of the invention.

This embodiment is distinguished from the second embodiment in that the back pressure chamber 60 communicates with the control pressure chamber 40 via the Pa supply port (second restriction passage) 5g, whereby the delivery pressure Pd in the high pressure chamber 43 is introduced into the back pressure chamber 60 via the Pc supply port (the first restriction passage) 48, the control pressure chamber 40, and the Pa supply port 5g.

According to the variable capacity vane compressor of the third embodiment, the back pressure chamber 60 is arranged downstream of the control pressure chamber 40. Therefore, similarly to the second embodiment, in a transient operating condition of the compressor wherein the rotational speed thereof suddenly drops, the back pressure Pa, which is developed within the back pressure chamber 60 when the control pressure Pc and the back pressure Pa increase through cut-off of the communication between the high pressure chamber 43 and the bellows chamber 44, becomes lower than the control pressure Pc developed within the control pressure chamber 40, thereby reducing the sliding resistance or friction between the rotation plate 20 and the cylinder 1. Therefore, in such a transient operating condition of the compressor, the catching phenomenon of failure of displacement of the piston 32 is prevented from occurring, thereby preserving the suction pressure substantially at a fixed level.

Further, according to the third embodiment, since the diameter of the Pa supply port 5g is made smaller than that of the Pc supply port 48, the Pa supply port 5g restricts the speed of propagation or introduction of the control pressure Pc from the control pressure chamber 40 into the back pressure chamber 60, thereby positively creating a difference between the control pressure Pc and the back pressure Pa, which makes it possible to perform the capacity control in a more stable manner.

What is claimed is:

1. In a variable capacity vane compressor including a hollow cylinder having an inner peripheral surface with a substantially elliptic cross-section, a rotor rotatably received within said hollow cylinder, said rotor having an outer peripheral surface and a plurality of vane slits formed in said outer peripheral surface, a pair of side blocks secured to opposite ends of said hollow cylinder for closing said hollow cylinder, said pair of side blocks having inner end surfaces facing said hollow cylinder, respectively, one of said inner end surfaces of said pair of side blocks being formed with an annular recess, at least one compression space defined by said inner peripheral surface of said cylinder, said outer peripheral surface of said rotor, and said inner end surfaces of said pair of side blocks, a plurality of vanes radially slidably fitted in said plurality of vane slits, respectively, a rotation plate received within said annular recess formed in said one of said inner end surfaces of said pair of side blocks for rotation between the minimum load position which sets the delivery quantity of said compressor to the minimum, and the maximum load position which sets the delivery quantity of said compressor to the maximum, a suction chamber into which a refrigerant gas is drawn in, and a drive mechanism responsive to suction pressure within said suction chamber for driving said rotation plate for rotation, the improvement comprising:

a thrust bearing arranged on an end face of said rotation plate on a side remote from said hollow cylinder;

an annular pressing member arranged in said one of said side blocks and abutting on said end face of said rotation plate on said side remote from said hollow cylinder via said thrust bearing; and a high pressure-introducing passage for introducing high pressure to an end face of said annular pressing member on a side remote from said rotation plate, to thereby urge said annular pressing member toward said thrust bearing.

2. A variable capacity vane compressor according to claim 1, wherein said high pressure is delivery pressure of said refrigerant gas discharged from said compression space.

3. A variable capacity vane compressor according to claim 2, wherein a delivery pressure-introducing chamber is provided at an intermediate portion of said high pressure-introducing passage, for attenuating variation in pressure of said refrigerant gas.

4. A variable capacity vane compressor according to claim 1, wherein the bottom of said annular recess is formed with an additional annular recess, and wherein said annular pressing member is received in said additional annular recess.

5. A variable capacity vane compressor according to claim 4, wherein a pressure chamber is defined between the bottom of said additional annular recess and said end face of said annular pressing member on said side remote from said rotation plate, into which is introduced said high pressure from said high pressure-introducing passage.

6. A variable capacity vane compressor according to claim 5, wherein a sealing member is provided between the bottom of said additional annular recess and said end face of said annular pressing member on said side remote from said rotation plate, for prevention of leakage of said high pressure within said pressure chamber to the outside thereof.

7. A variable capacity vane compressor according to claim 1, wherein said drive mechanism comprises a control pressure chamber in which control pressure is developed, a piston responsive to variation in said control pressure for performing reciprocating motion to rotate said rotation plate, a high pressure chamber into which is introduced delivery pressure discharged from said compression space, a first restriction passage communicating between said control pressure chamber and said high pressure chamber, and a pressure control valve mechanism responsive to said suction pressure for controlling the state of communication between said suction chamber and said high pressure chamber to thereby vary said control pressure according to said suction pressure.

8. A variable capacity vane compressor according to claim 7, including:

a back pressure chamber facing said end face of said annular pressing member on said side remote from said rotation plate; and a second restriction passage communicating between said high pressure chamber and said back pressure chamber, said second restriction passage being smaller in diameter than said first restriction passage.

9. A variable capacity vane compressor according to claim 8, wherein the capacity of said back pressure chamber is larger than the capacity of said control pressure chamber when said rotation plate is positioned in said minimum load position.

10. A variable capacity vane compressor according to claim 7, including:

a back pressure chamber facing said end face of said annular pressing member on said side remote from said rotation plate; and a second restriction passage communicating between said high pressure chamber and said back pressure chamber, wherein delivery pressure within said high pressure chamber is introduced to said back pressure chamber via said first restriction passage, said control pressure chamber, and said second restriction.

11. A variable capacity vane compressor according to claim 10, wherein said second restriction passage is smaller in diameter than said first restriction passage.

12. A variable capacity vane compressor according to claim 2, wherein the bottom of said annular recess is formed with an additional annular recess, and wherein said annular pressing member is received in said additional annular recess.

13. A variable capacity vane compressor according to claim 3, wherein the bottom of said annular recess is formed with an additional annular recess, and wherein said annular pressing member is received in said additional annular recess.

* * * * *